US008620010B2

(12) United States Patent
Gunnarsson

(10) Patent No.: US 8,620,010 B2
(45) Date of Patent: Dec. 31, 2013

(54) LOUDSPEAKER DEVICE

(75) Inventor: Fredrik Gunnarsson, Karlstad (SE)

(73) Assignee: Embracing Sound Experience AB, Karlstad (SE)

( * ) Notice: Subject to any disclaimer, the term of this patent is extended or adjusted under 35 U.S.C. 154(b) by 977 days.

(21) Appl. No.: 12/297,225

(22) PCT Filed: Apr. 19, 2007

(86) PCT No.: PCT/SE2007/000373
§ 371 (c)(1),
(2), (4) Date: Oct. 15, 2008

(87) PCT Pub. No.: WO2007/120103
PCT Pub. Date: Oct. 25, 2007

(65) Prior Publication Data

US 2009/0175472 A1 Jul. 9, 2009

(30) Foreign Application Priority Data

Apr. 19, 2006 (SE) ..... 0600858

(51) Int. Cl.
*H04R 5/02* (2006.01)

(52) U.S. Cl.
USPC ..... 381/303; 381/89; 381/77; 381/71.1; 381/80; 381/94.2

(58) Field of Classification Search
USPC ..... 381/300, 303, 304, 338, 339, 345, 1, 2, 381/17, 301, 302, 306, 308, 309, 71.1, 77, 381/80, 87, 89, 332, 335, 94.1, 94.2
See application file for complete search history.

(56) References Cited

U.S. PATENT DOCUMENTS 2,093,540 A 9/1937 Blumlein
2,836,662 A 5/1958 Vanderlyn
(Continued)

FOREIGN PATENT DOCUMENTS

DE 1 147 983 8/1959
EP 0 773 702 A2 5/1997
(Continued)

OTHER PUBLICATIONS

H. Evers, "The Use of MS Techniques and MS Signals in Swedish Television", Proceedings of the 9th International AES Conference, Feb. 1, 1991, pp. 127-132.

(Continued)

*Primary Examiner* — Cuong Q Nguyen
*Assistant Examiner* — Galina Yushina
(74) *Attorney, Agent, or Firm* — Dickstein Shapiro LLP

(57) ABSTRACT

The present invention relates to a loudspeaker device, comprising first and second closely located and individually acoustically isolated loudspeaker elements. The first and second elements are arranged to receive a first signal and a second signal, respectively, at least part of said first signal being in anti-phase relative to said second signal. The device further includes third and fourth loudspeaker elements, being located in close proximity to said first and second loudspeaker elements, respectively. The center of said third loudspeaker element is located such that a first axis intersecting the center of said first loudspeaker element and the center of said third loudspeaker element is inclined an angle ϕ relative to a horizontal plane, ϕ being in the range 0°-+30°, and the center of said fourth loudspeaker element is located such that a second axis intersecting the center of said second loudspeaker element and the center of said fourth loudspeaker element is inclined at an angle cp relative to a horizontal plane, ϕ being 0°-±30°. The first and second signals to said third and fourth loudspeaker elements, respectively, are low-pass filtered, the cut-off frequency of said low-pass filters being less than or equal to 2.5 kHz.

20 Claims, 4 Drawing Sheets

(56) References Cited

U.S. PATENT DOCUMENTS

| | | | | | |
|---|---|---|---|---|---|
| 2,845,491 | A | | 7/1958 | Bertram | |
| 3,241,631 | A | | 3/1966 | Manieri | |
| 3,308,237 | A | * | 3/1967 | Novak | 381/98 |
| 3,560,656 | A | | 2/1971 | Gilbert | |
| 3,892,624 | A | * | 7/1975 | Shimada | 381/308 |
| 3,947,635 | A | * | 3/1976 | Frankman | 381/301 |
| 3,970,787 | A | | 7/1976 | Searle | |
| 4,020,284 | A | * | 4/1977 | Phillips | 381/2 |
| 4,069,394 | A | | 1/1978 | Doi et al. | |
| 4,149,036 | A | | 4/1979 | Okamoto et al. | |
| 4,218,585 | A | * | 8/1980 | Carver | 381/303 |
| 4,349,697 | A | | 9/1982 | Skabla | |
| 4,356,349 | A | | 10/1982 | Robinson | |
| 4,394,537 | A | | 7/1983 | Shima et al. | |
| 4,418,243 | A | | 11/1983 | Fixler | |
| 4,489,432 | A | * | 12/1984 | Polk | 381/304 |
| 4,572,325 | A | | 2/1986 | Schupbach | |
| 4,596,034 | A | | 6/1986 | Moncrieff | |
| 4,630,298 | A | * | 12/1986 | Polk et al. | 381/1 |
| 4,819,269 | A | | 4/1989 | Klayman | |
| 4,837,826 | A | | 6/1989 | Schupbach | |
| 4,866,774 | A | | 9/1989 | Klayman | |
| 5,117,459 | A | | 5/1992 | McShane | |
| 5,502,772 | A | | 3/1996 | Felder | |
| 5,546,468 | A | | 8/1996 | Beard | |
| 5,553,147 | A | | 9/1996 | Pineau | |
| 5,579,395 | A | | 11/1996 | Horl | |
| 5,579,396 | A | | 11/1996 | Iida et al. | |
| 5,596,034 | A | | 1/1997 | Krishnan et al. | |
| 5,850,454 | A | | 12/1998 | Hawks | |
| 5,870,484 | A | | 2/1999 | Greenberger | |
| 5,883,962 | A | | 3/1999 | Hawks | |
| 5,892,830 | A | | 4/1999 | Klayman | |
| 5,896,456 | A | | 4/1999 | Desper | |
| 5,970,153 | A | | 10/1999 | Petroff | |
| 6,069,962 | A | | 5/2000 | Miller | |
| 6,169,812 | B1 | | 1/2001 | Miller | |
| 6,590,983 | B1 | | 7/2003 | Kraemer | |
| 6,633,648 | B1 | * | 10/2003 | Bauck | 381/303 |
| 6,691,289 | B2 | | 2/2004 | Chae et al. | |
| 6,731,765 | B1 | | 5/2004 | Sotome | |
| 6,991,289 | B2 | | 1/2006 | House | |
| 2004/0170281 | A1 | | 9/2004 | Nelson et al. | |
| 2005/0089191 | A1 | * | 4/2005 | Yamaguchi et al. | 382/100 |
| 2005/0097181 | A1 | * | 5/2005 | Bishop et al. | 709/209 |
| 2005/0201582 | A1 | | 9/2005 | Hughes, II et al. | |
| 2005/0221867 | A1 | | 10/2005 | Zurek et al. | |

FOREIGN PATENT DOCUMENTS

| | | | | |
|---|---|---|---|---|
| WO | WO 97/30566 | | 8/1997 | |
| WO | WO 98/36614 | | 8/1998 | |
| WO | WO 99/33173 | | 7/1999 | |
| WO | WO 00/22876 | | 4/2000 | |
| WO | WO 01/39547 | | 5/2001 | |
| WO | WO 01/39548 | | 5/2001 | |
| WO | WO 2005/009078 | * | 1/2004 | H04S 1/00 |
| WO | WO 2005/009078 | | 1/2005 | |

OTHER PUBLICATIONS

B. B. Bauer, "Phasor Analysis of Some Stereophonic Phenomena", J. Acous. Soc. Am., vol. 33, No. 11. p. 1536, Nov. 1961.

M. Gayford, Microphone Engineering Handbook, ISBN 07506 1199 5, pp. 395-396 (1994).

J. Eargle, Handbook of Recording Engineering, ISBN0-442-0053-9, pp. 258-259 (1993).

T. M. Crown et al., "The Effects of Interaural Crosstalk on Stereo Reproduction Minimizing Interaural Crosstalk in Nearfield Monitoring by the Use of a Physical Barrier", Crown International, Inc., Presented at the 81st Convention, Nov. 12-16, 1986, Los Angeles, CA, p. 80 & Fig. 42.

M. M. Goodwin, et al., "Constant Beamwidth Beamforming", Proceedings of the International Conference on Acoustics, Speech and Signal Processing (ICASSP) vol. 1, Apr. 27, 1993 pp. 169-172.

* cited by examiner

Prior Art

LOUDSPEAKER DEVICE

FIELD OF THE INVENTION

The present invention relates to loudspeaker devices for reproduction of audio stereo signals.

BACKGROUND OF THE INVENTION

Once, the expectations on reproduced audio sound were no greater than what monophonic reproduction could produce, and, accordingly, this satisfied most listeners. In course of time, however, the demand on high quality reproduction of stereo sound, e.g., recordings from a recording studio or recordings from a live concert, has been constantly increasing.

Consequently, various systems have been developed, each being able to reproduce true stereo sound to a greater or lesser extent.

The system that most readily comes to mind is a conventional system for stereophonic reproduction wherein left and right side speakers are disposed in front of a listener and with a certain distance separating the speakers. Most reproduction systems of today are based on this technology. However, true reproduction of the electrical stereo signal, both in terms of relative intensity between the sound waves perceived by the ears of the listener and the time difference between these, can at best be perceived only at one single position in relation to the loudspeakers, as these methods are often subject to incorrect translation of the electrical stereo information due to preferences of the separate loudspeakers and how the loudspeakers are positioned in relation to the listener.

The system coming closest to virtually move the listener to the recording location, i.e. to convey an impression of the true location of the different sound sources of the original event, is the binaural method of recording and the binaural method of reproduction (headphones). There are, however, a number of loudspeaker systems that introduce so called crosstalk cancellation by means of DSP, see, for example, U.S. Pat. No. 3,236,949 and U.S. Pat. No. 5,862,227. The purpose of such systems is to eliminate the signal that is reaching the left ear from the right speaker and vice versa. This is in order to create a binaural loudspeaker system. The disadvantage of such a system is that the complexity of the cross talk cancellation signal itself is degrading the sound quality. All other ways than the binaural method to record and reproduce sound, such as the above conventional two speaker set-up, is a creation of an imaginary sound image that is truly subjective and need not have even a remote resemblance with the actual experience at the recording position.

Consequently, there exists a need for a sound reproduction system that provides identical reproduction of the stereo sound image regardless of setup and quality of the loudspeakers. One such system that solves this problem is described in the patent application WO 01/39548, assigned to the applicant of the present invention, which discloses a method of processing and reproducing an input audio stereo signal. The system described in WO 01/39548 allows an audio stereo signal to be reproduced with a high degree of fidelity with high consistency in the perceived stereo image regardless of the quality of system.

A problem with such a system with closely located loudspeaker units, however, is that as the distance between loudspeaker units and listener increases, the performance of the system as regarding the fidelity in perceived stereo effect at the listeners location degrades with increasing distance and in the extreme case vanishes totally. Consequently, there exists a need for an improved system for reproducing sound.

SUMMARY OF THE INVENTION

It is an object of the present invention to provide a loudspeaker device that solves the above mentioned problem. This object is achieved by a loudspeaker device as defined in the characterising portion of claim 1.

According to the present invention, the loudspeaker device comprises first and second loudspeaker elements, which are located in close proximity to each other, wherein said first and second loudspeaker elements are arranged to radiate sound in a first direction of propagation, wherein said first and second loudspeaker elements are acoustically isolated and arranged to receive a first signal and a second signal, respectively, at least part of said first signal being in anti-phase relative to said second signal, wherein said device further includes third and fourth loudspeaker elements, arranged to propagate sound in said first direction. Said third loudspeaker element is located in close proximity to said first loudspeaker element and is arranged to receive at least part of said first signal. Said fourth loudspeaker element being located in close proximity to said second loudspeaker element and arranged to receive at least part of said second signal. The centre of said third loudspeaker element is located such that a first axis, intersecting the centre of said first loudspeaker element and the centre of said third loudspeaker element, is inclined an angle $\phi$ relative to a horizontal plane. The centre of said fourth loudspeaker element is located such that a second axis, intersecting the centre of said second loudspeaker element and the centre of said fourth loudspeaker element, is inclined at an angle $\phi$ relative to a horizontal plane, $\phi$ being $0°-\pm30°$. Preferably said third and fourth elements are arranged such that said first and second axis have equal absolute values of $\phi$ and intersect at a point substantially on a vertical axis passing between said first and second elements. The signals to the said third and fourth elements are low-pass filtered, the cut-off frequency of said low-pass filters being less than 2.5 kHz.

This has the advantage that a similar effect as of a loudspeaker element of considerable larger diameter is achieved, i.e., the elements will function as a dipole further out from the device, which has as result that the perceived stereo effect at a listener location some distance from the loudspeaker is substantially improved for frequencies, in particular in the range from $f_0$ of the loudspeaker element to 2.5 kHz, wherein $f_0$ is the resonance frequency of the loudspeaker element. The low-pass filtering of the signals to said third and fourth loudspeaker elements avoid alteration of the high frequency lobe pattern. Further, using a loudspeaker element configuration according to the present invention makes possible an improved stereo reproduction in applications wherein element dimensions, especially element height, is restricted.

A distance D between the centre of said first element and the centre of said third element, and between the centre of said second element and the centre of said fourth element should be less than or equal to twice the diameters d of said first and second elements in order to fully benefit from the advantages of the present invention.

Further loudspeaker elements may be arranged in close proximity to said first and second elements, and/or said third and fourth elements. This has the advantage that the perceived stereo effect for certain frequencies may be improved even further.

Said first and second loudspeaker elements may constitute a pair of identical loudspeaker elements, and may be located within less than one quarter of the shortest wavelength emitted by the elements, or, if the shortest wavelength emitted by the elements is less than 68 cm, less than 17 cm.

Further, said first signal may be equivalent to the sum of a mid input signal (M) and a side input signal (S), and said second signal may be equivalent to the sum of a mid input signal (M) and a side signal (S) phase shifted 180°.

Further, at least part of the side input signal (S) or the mid input signal (M) may be phase shifted approximately 45°-135° prior to or at the production of the first and second signals.

Said device may be an integrated part in an apparatus constituting any from the group: Studio Monitor, HiFi system, Home Cinema system, Compact Hifi system, Personal Radio system, TV Set, Laptop, PC Monitor, Personal Computer, Multimedia Speaker, Mobile Phone, PDA.

DESCRIPTION OF A PREFERRED EMBODIMENT

Figure 1:
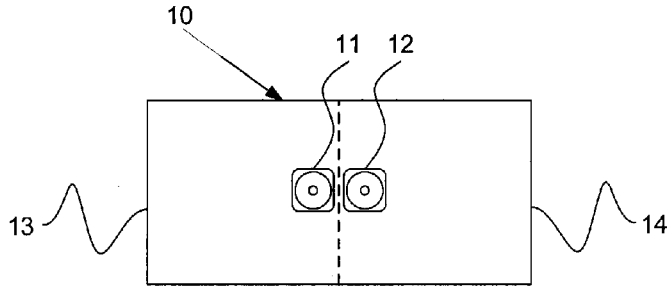
FIG. 1 discloses a prior art loudspeaker device.

FIG. 1 shows a prior art loudspeaker device 10. The loudspeaker device 10 comprises a first side 13 and a second side 14. The first side 13 comprises a first loudspeaker element 11, and the second side 14 comprises a second loudspeaker element 12. The disclosed device 10 is intended for stereo reproduction of an input stereo signal, and although the loudspeaker device 10 consists of a common enclosure, the resonator volumes, or cavities, of the loudspeaker elements 11 and 12 are acoustically isolated from each other. The term acoustical isolation does, in the present description and claims, here imply that no, or little, sound is transferred from one resonator volume to the other.

Figure 2:
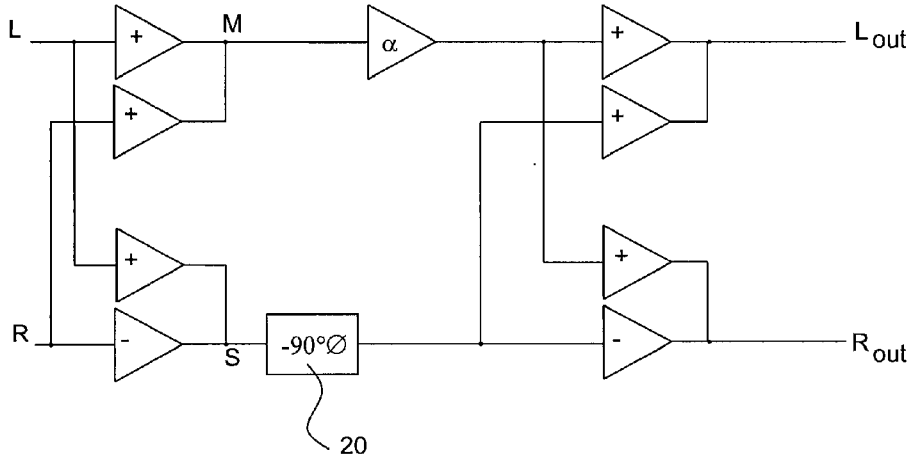
Prior Art Fig. 2
FIG. 2 is a block diagram illustrating a prior art system for processing stereo signals.

The disclosed loudspeaker device may, e.g., be utilised for reproduction of sound according to a method as disclosed in FIG. 2, wherein a conventional input audio stereo signal comprises a left input stereo signal L and a right input stereo signal R. The L and R signals are used to obtain a mid signal M, and a side signal S, corresponding to the sum of the left L and right R input stereo signals, and the difference between the left L and right R input stereo signals, respectively. The output stereo signal $L_{OUT}$, is to be sent to a left side sound reproducing unit, in this case the loudspeaker element 11 of the first side 13, and constitutes the sum of the side signal, S, and the mid signal M multiplied by an attenuating factor $\alpha$, e.g., in the range −3 dB to −15 dB, while the output stereo signal $R_{OUT}$, which is to be sent to a right side sound reproducing unit (in this case, the loudspeaker element 12 of the right hand side 14) is the sum of the inverted side signal, S, and the mid signal M multiplied by an attenuating factor $\alpha$.

This signal processing together with a loudspeaker device as disclosed in FIG. 1 allows an electrical audio stereo signal to be reproduced with a high degree of fidelity with high consistency in the perceived stereo image. In order to improve the degree of fidelity in perceived stereo effect at frequencies above 1-5 kHz, the side signal S may, as is disclosed in the figure, be phase shifted −90° prior to the creation of the output stereo signals $L_{OUT}$, and $R_{OUT}$, using phase shifting means 20. This method is described in detail in the international patent application WO 2005/009078. Instead of a 90° phase shift, the phase shift may be any phase shift in an interval between 45°-135°, and, optionally, it may be performed on the mid signal M instead.

In the described system, the closely located loudspeaker elements 11 and 12 should, for optimum performance, be located such that a minimal coloration caused by lobing in the resultant emitted sound pattern due to interference between the loudspeaker elements is obtained. This is achieved when the distance between the loudspeaker elements is smaller than one quarter of the wavelength of the sound being emitted. Achieving this implies that higher frequency loudspeaker elements should be put closer to each other than lower frequency loudspeaker elements. In practice, this means that the distance between the centres of the elements should be less than one quarter of the shortest wavelength emitted by the elements, or, if the shortest wavelength emitted by the elements is less than 68 cm (i.e., frequencies >500 Hz), at least no longer than 17 cm, preferably closer. Arranging the elements 11, 12 in this way has as result that the elements will act as a dipole.

Figure 3A:
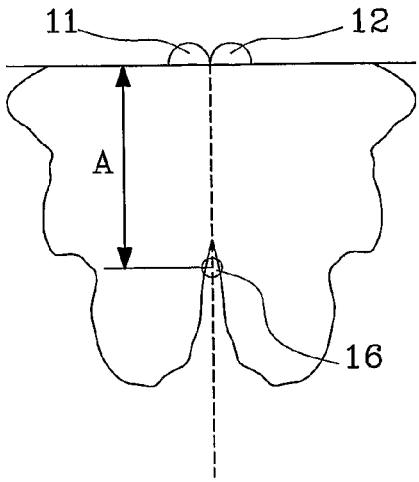
FIG. 3*a-c* discloses lobe patterns for various frequencies radiated by the FIG. 1 system.

The lobe pattern for frequencies wherein $\lambda$ (wavelength) is short relative to the diameter of the speaker element, i.e. high frequencies, when the elements are functioning as a dipole, is shown in FIG. 3*a*. As can be seen in the figure, the elements 11 and 12 act as a dipole up to a distance A from the loudspeaker elements before the lobe pattern separates and the dipole effect is lost to the ears of the listener. When the elements 11, 12 are acting as a dipole, they consume energy from each other, i.e., there are signal cancellations, or partial cancellations, in areas where the signals overlap, said cancellations resulting in a perceived stereo effect at the location of a listener 16. Consequently, a satisfactory stereo effect is provided to a listener being at a maximum distance A from the loudspeaker elements. If the listener is located further away from the elements 11, 12, a deteriorated stereo effect or no stereo effect at all will be exhibited by the listener. For high frequency signals, however, the distance A usually is long enough to be sufficient in most situations.

Figure 3B:
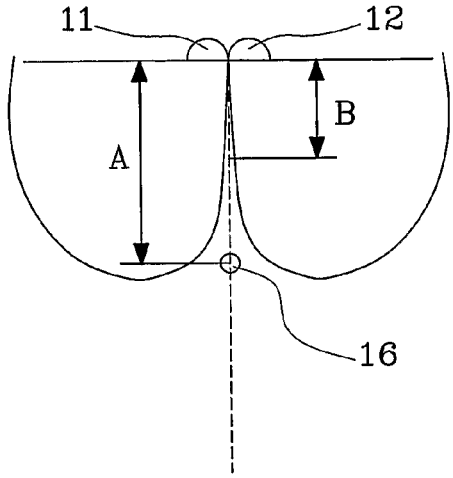

However, as the wavelength increases, i.e., for lower frequencies wherein $\lambda < d_{element}$, $d_{element}$ being the diameter of a respective element, the lobe pattern from the same set of loudspeaker elements 11, 12 will exhibit the lobe pattern of FIG. 3*b*. I.e., the elements 11 and 12 still acts as a dipole, but now the lobe pattern separates at a distance B<A from the loudspeaker elements, wherein the dipole effect is lost at positions beyond B. Consequently, the listener of FIG. 3*a*, at a distance A from the loudspeaker device 10, will not experience a satisfactory stereo effect in regard to these lower frequencies, and it is quite possible that the distance B will be considered as far too short even in an ordinary living room.

Figure 3C:
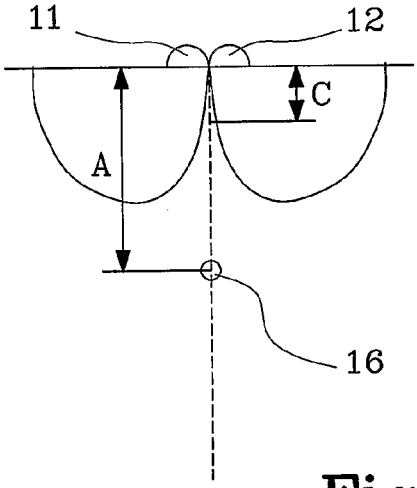

This effect is worsened as the frequency decreases. The relevant frequency interval is the frequency interval ranging from the resonance frequency $f_0$ of the loudspeaker elements up to about 1.5-2.5 kHz, above which the situation in FIG. 3*a* usually prevails. If the situation in FIG. 3*a* corresponds to 1.5 kHz, and the situation in FIG. 3*b* corresponds to 750 Hz, the situation may be as bad as in FIG. 3*c*, wherein the dipole effect separates at a distance C, C<B<A, when it comes to frequencies around 2-300 Hz. This means that a satisfactory stereo effect is only obtained at locations very near the device 10, which, for consumer electronics such as TV sets or hi-fi systems, may be quite impractical and considered as far too short by the listener. Thus, there is a need for an improved loudspeaker device which at least reduces the above problem and increases the distance at which a satisfactory stereo effect for lower frequencies may be experienced by a listener.

Figure 3D:
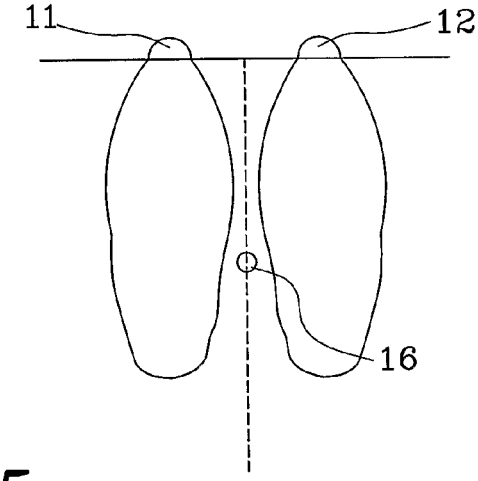
FIG. 3*d* discloses a lobe pattern for loudspeaker elements more spaced apart.
Figure 4:
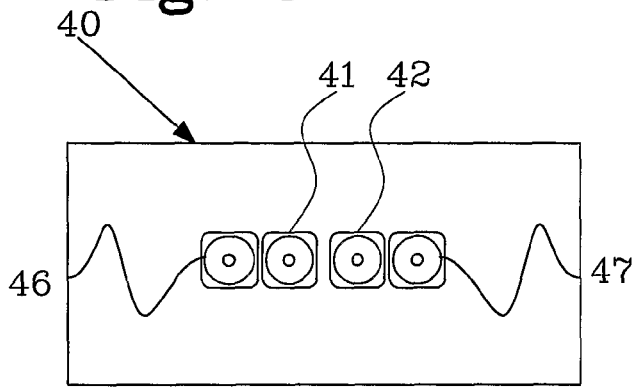
FIG. 4 discloses a loudspeaker device according to an exemplary embodiment of the present invention.

In FIG. 4 is shown a loudspeaker device according to an exemplary embodiment of the present invention. The loudspeaker device is similar to the device in FIG. 1, however now provided with two additional elements 46, 47, in this example similar to the elements 41, 42. The frequency range of the elements 46, 47 at least partially overlap the frequency range of the elements 41, 42, and may be identical to the frequency range of the elements 41, 42, in which case the elements are fed by the same frequency range of the output signal. The elements 46, 47 are added in order to improve the stereo reproduction for lower frequencies, and do so by adding loudspeaker element surface. The increase in element surface playing a specific frequency has as result that the maximum wavelengths for which the dipole effect is achieved at position A increases, i.e., the desired function is obtained for lower frequencies since $\lambda<d_{element}$ will be valid for longer wavelengths. The addition of the element 46 (47), having an equal surface as the element 41 (42) is equal to having a single element 41' (42') (not shown) having a diameter $\sqrt{2}*d_{41}$, i.e., about 41% greater than the diameter of element 41 (42). Consequently, the present invention provides the same effect as a loudspeaker element of considerable larger diameter. Accordingly, the advantage of using a configuration according to the present invention is that it improves stereo reproduction in applications wherein element dimensions, especially element height, is restricted. Such limitations are common, e.g. in consumer electronics and mobile telephones. Further, if the diameter of the elements 41, 42, and thereby the centre-to-centre distance, is too large, i.e., the dipole effect of the elements may be lost altogether, whereby the lobe pattern will equal that of a bipole instead. This is disclosed in FIG. 3*d*, wherein the radiated lobes of the elements do not interact, and thereby deteriorates or totally ruins the perceived stereo effect at a listener location. Consequently, the ability to arrange the elements 41, 42 in close proximity to each other is extremely important, and this requirement is fulfilled by the present invention.

For optimum performance, the separation of the elements 41 and 46, and 42 and 47, respectively, preferably should fulfil the relation d=D, i.e., the diameters d of loudspeaker elements 46, 47 should equal the distance D between the centre of the element 41 (42) and the centre of the element 46 (47). If this condition can not be fulfilled, the diameter d of the elements 46, 47 should preferably be less than or equal to twice the distance D in order to ensure a satisfactory stereo reproduction. Due to space limitations, as stated above, it is common to use elliptic loudspeaker elements, e.g., in order to reduce height and/or width of a device. When such elements are used, the diameter d represents the minor axis of the ellipse, and, consequently, this brings about restrictions on eccentricity of the ellipse.

Figure 5:
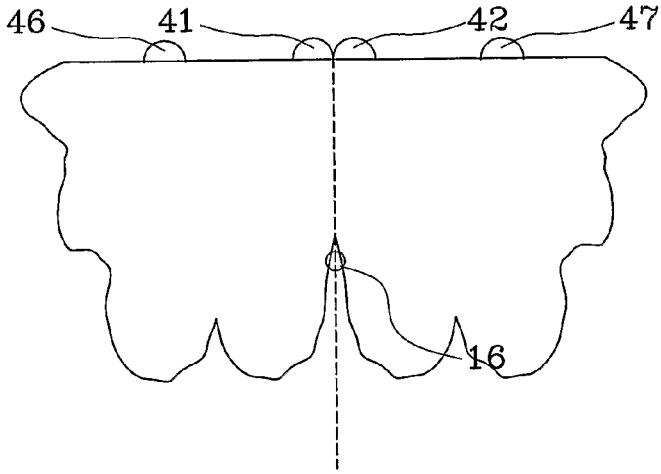
FIG. 5 shows an example of a lobe pattern from two closely located loudspeaker elements acting as a bipole.

Use of the extra elements 46, 47, however, has, as is shown in FIG. 5, the disadvantage that these elements will contribute to the total lobe pattern of the device 40 by individual additional lobes. This means that these lobe patterns will interfere with the lobe pattern of elements 41, 42, and may thereby reduce the quality of high frequency reproduction while improving low frequency reproduction. Therefore, the signals to the elements 46, 47 are low-pass filtered. This means that while the elements 41, 42 reproduces the input signal full range, i.e., throughout the capability of the element or the portion of the frequency range apportioned to said element, the elements 46, 47 will only reproduce the same signal up to a certain frequency.

The signals to the elements 46, 47 are preferably low-pass filtered such that the cut-off frequency of said loudspeaker elements is less than or equal to 2.5 kHz or c/3D, wherein c is the speed of sound in the medium, e.g., ~340 m/s in room tempered air. Consequently, the lobe pattern of the elements 41, 42 will be substantially undisturbed for frequencies above the cut-off frequency of the low-pass filter. In an example the cut-off frequency is set to ~1.5 kHz.

The disclosed embodiment has the advantage that the distances B and/or C are increased with a maintained possibility of implementing the present invention where there are space requirements, and thereby enable a listener to increase the distance to the loudspeaker device 40 while still maintaining a satisfactory stereo reproduction for a wider frequency range and without substantially disturbing the stereo reproduction for higher frequencies.

Figure 6:
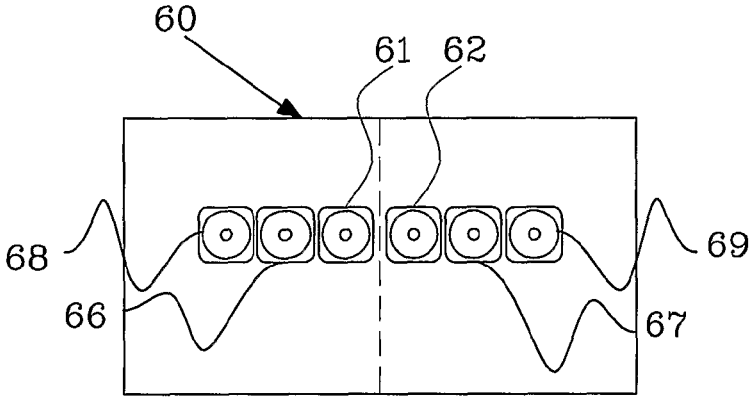
FIGS. 6-9 show alternative exemplary embodiments of the present invention.

In order to improve the ability to reproduce an input stereo audio signal even further, more loudspeaker elements may be added. This is disclosed in FIG. 6, wherein, in comparison to FIG. 1, four additional elements 66-69 are provided, two to each side. This has the advantage that the effective loudspeaker element area is increased further. Regarding the elements 66, 67, the signals feeding these should preferably be low-pass filtered as above. For the same reasons, also the signal to the elements 68, 69 should be low-pass filtered, wherein the corresponding equation $c/3D_x$ applies, wherein $D_x$ is defined as the distance between the centres of the centremost element (61 or 62) and a particular element x, e.g., element 68.

Figure 7:
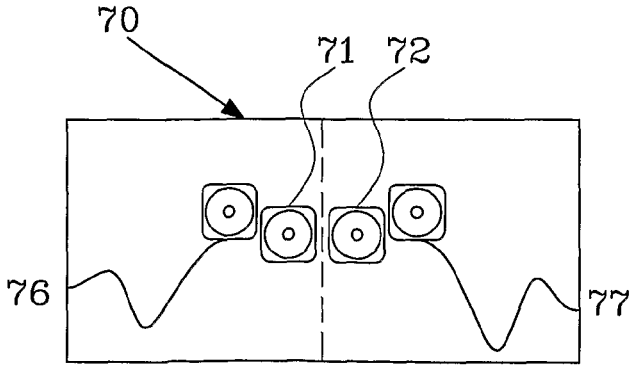

Hitherto, the elements have been described as being located along a horizontal axis. It is, however, if the application so permits, possible to arrange the additional elements with an angle relative to the centremost element. For example, only the centremost element may be subject to space restrictions, while the outer elements may be positioned more freely. One such example is shown in FIG. 7, wherein the elements 76, 77 are arranged at an inclined angle relative to the elements 71, 72. The centre of the element 76 is located such that a first axis intersecting the centre of the element 71 and the centre of the element 76 is inclined an angle $\phi$, wherein $\phi$ is 0°-±30° relative to a horizontal plane. Further, The centre of the element 77 is located such that a second axis intersecting the centre of the element 72 and the centre of the element 77 is inclined at an angle $\phi$ relative to a horizontal plane, $\phi$ being 0°-±30°. The inclination angle should not be more than ±30 degrees in order to prevent disturbance of vertical lobe pattern. Preferably, the elements 76, 77 should be arranged such that said first and second axis have equal absolute values of $\phi$ and intersect at a point substantially on a vertical axis passing between the elements 71, 72.

Figure 8:
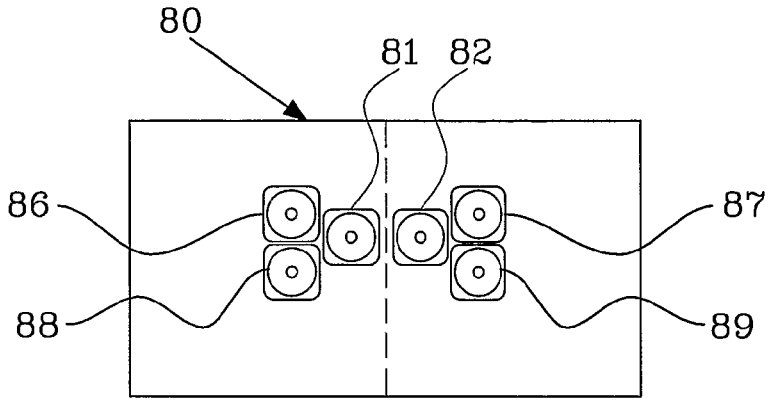

Further, in FIG. 8 is shown another exemplary embodiment wherein two additional elements 86, 88 and 87, 89, respectively, are arranged at inclined angles relative to the centremost elements 81, 82.

Figure 9:
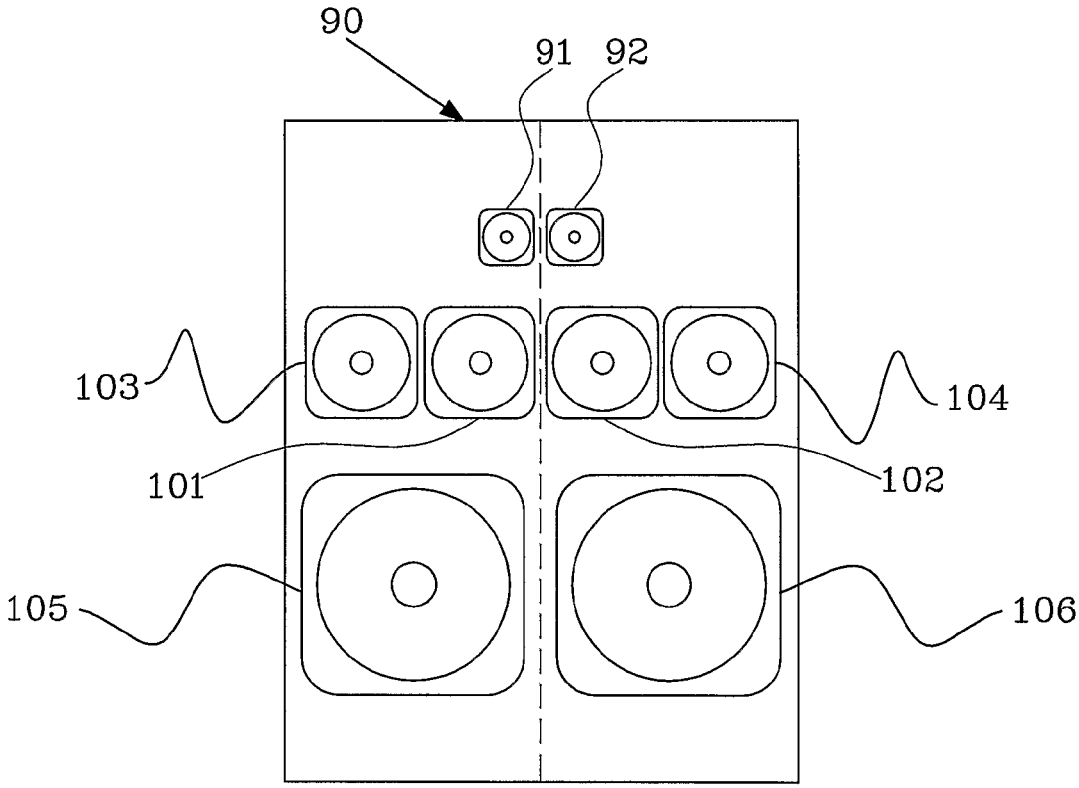

In the above examples, the present invention has been disclosed as a single set of elements. In FIG. 9 is shown an alternative embodiment, wherein different sets of elements reproduce signals having different frequency ranges. The disclosed device comprises a first set of elements 91-92, which are used for high-frequency reproduction, i.e., reproduce the uppermost of the frequency range of the device, that is, a high-pass filtered portion of the frequency range e.g., frequencies above 2.5 kHz. The set of elements 101-104 functions as above and reproduces frequencies of a frequency there below. Since mid-range elements by nature have a larger diameter, a low-pass filter cut-off frequency of no more than c/3D will ensure proper function. Consequently, this embodiment has the advantage that an even larger element surface may be obtained for lower frequencies, since the high-frequency range is handled by a separate set of loudspeaker elements. Further, as stated above, lower frequency loudspeaker elements may be arranged more spaced apart without loosing the dipole effect.

The disclosed device further comprises loudspeaker elements 105-106, which are used for reproduction of the lowest frequency range, e.g., frequencies below 200 Hz. Naturally, additional elements according to the present invention could be used for the elements 105, 106 as well.

In the above description, the present invention has been disclosed in connection with a "conventional" loudspeaker device intended as a substitute to a conventional two-speaker stereo system. The present invention, however, is applicable everywhere wherein closely located loudspeaker elements may be used to reproduce stereo sound. Such devices include, but are not restricted to, Studio Monitors, HiFi Speakers, Home Cinema, Compact Hifi, Personal Radios, Car Stereo System, TV-Sets, Laptops, PC Monitors, Multimedia Speakers, Mobile Phones.

For example, in portable telephones, such as cell phones, two full range loudspeaker elements may be utilised to reproduce stereo sound. In such telephones, the available space is often very limited, and the loudspeaker elements are often subject to constraints regarding possible diameter, which, as disclosed above, has an adverse effect on the stereo reproduction of lower frequencies. Further, many modern TV sets have similar problems as the loudspeaker elements often are arranged below the screen and therefore should have as small diameter as possible. Use of an additional set of speaker elements according to the present invention, preferably using low-pass filtering of the signal to the outer elements, may substantially increase the stereo quality of mobile telephones and TV sets.

In the above description, the loudspeaker device has been disclosed as an integral unit. Alternatively, it could consist of two separate units, placed in immediate vicinity of each other, or even being attached to each other.

Inasmuch as the present invention is subject to variations, modifications and changes in detail, some of which have been stated herein, it is intended that all matter described throughout this entire specification or shown in the accompanying drawings be interpreted as illustrative and not in a limiting sense.

The invention claimed is:

1. Loudspeaker device, comprising first and second loudspeaker elements, which are located in close proximity to each other, wherein said first and second loudspeaker elements are arranged to radiate sound in a first direction of propagation, wherein said first and second loudspeaker elements are acoustically isolated and arranged to receive a first signal and a second signal having a first frequency range, respectively, at least part of said first signal being in antiphase relative to said second signal, wherein said device further includes third and fourth loudspeaker elements, arranged to propagate sound in said first direction, said third loudspeaker element being located in close proximity to said first loudspeaker element and arranged to receive at least part of said first signal, the center of said third loudspeaker element being located such that a first axis intersecting the center of said first loudspeaker element and the center of said third loudspeaker element is inclined an angle $\phi$ relative to a horizontal plane, $\phi$ being in the range 0°-±30°, said fourth loudspeaker element being located in close proximity to said second loudspeaker element and arranged to receive at least part of said second signal, the center of said fourth loudspeaker element being located such that a second axis intersecting the center of said second loudspeaker element and the center of said fourth loudspeaker element is inclined at an angle $\phi$ relative to a horizontal plane, $\phi$ being 0°-±30°, characterized in said first and second signals to said third and fourth loudspeaker elements, respectively, being low-pass filtered, the cut-off frequency of said low-pass filters being less than or equal to 2.5 kHz, the signals being received by said third and fourth loudspeaker elements having substantially the same amplitude as the signals being received by said first and second loudspeaker elements in said low-pass filtered portion of said first frequency range.

2. Loudspeaker device according to claim 1, wherein an axis intersecting the centers of said first and second loudspeaker element is substantially horizontal.

3. Loudspeaker device according to claim 1, wherein said cut-off frequency of said low-pass filters is less than or equal to c/3D,c being the speed of sound in the medium, and in any case less than or equal to 2.5 kHz, wherein the distance D is the distance between the center of said first loudspeaker element and the center of said third loudspeaker element, and/or between the center of said second loudspeaker element and the center of said fourth loudspeaker element, respectively.

4. Loudspeaker device according to claim 1, characterized in that said third and fourth loudspeaker elements are arranged such that said first and second axis have equal absolute values of $\phi$ and intersect at a point substantially on a vertical axis passing between said first and second loudspeaker elements.

5. Loudspeaker device according to claim 1, characterized in that said third and fourth loudspeaker elements are individually acoustically isolated by means of individual resonator volumes.

6. Loudspeaker device according to claim 1, characterized in that said first and third loudspeaker elements are acoustically isolated by means of a common resonator volume, and wherein and said second and fourth loudspeaker elements are acoustically isolated using a common resonator volume.

7. Loudspeaker device according to claim 1, characterized in that the distance D between the center of said first loudspeaker element and the center of said third loudspeaker element, and between the center of said second loudspeaker element and the center of said fourth loudspeaker element, respectively, is less than or equal to twice the diameters d of said first and second loudspeaker elements.

8. Loudspeaker device according to claim 1, characterized in that the diameters d of said third and fourth loudspeaker elements are less than or equal to twice the distance D between the center of said first loudspeaker element and the center of said second loudspeaker element.

9. Loudspeaker device according to claim 1, wherein said device further includes:

a fifth loudspeaker element, located adjacent to said first and/or third loudspeaker element, and a sixth loudspeaker element, located adjacent to said second and/or fourth loudspeaker element.

10. Loudspeaker device according to claim 9, characterized in that the signals to said fifth and sixth loudspeaker elements are low-pass filtered, the cut-off frequency of said low-pass filters being less than or equal to $c/3D_x$, c being the speed of sound in the medium, and in any case less than or equal to 2.5 kHz, wherein the distance $D_x$ is the distance between the center of said first loudspeaker element and the center of said fifth loudspeaker element and/or the distance between the center of said second loudspeaker element and the center of said sixth loudspeaker element.

11. Loudspeaker device according to claim 1, characterized in that at least said first, second third and fourth loudspeaker elements are identical loudspeaker elements.

12. Loudspeaker device according to claim 1, characterized in that at least said first, second third and fourth loudspeaker elements have substantially the same diameter.

13. Loudspeaker device according to claim 1, characterized in that at least said first, second third and fourth loudspeaker elements are designed for reproducing substantially the same frequency range.

14. Loudspeaker device according to claim 1, characterized in said first and second loudspeaker elements constituting a pair of identical loudspeaker elements, and being located within less than one quarter of the shortest wavelength emitted by the loudspeaker elements, or, if the shortest wavelength emitted by the loudspeaker elements is less than 68 cm, less than 17 cm.

15. Loudspeaker element according to claim 14, characterized in that the centers of said loudspeaker elements are located within less than one quarter of the shortest wavelength emitted by the loudspeaker elements, or, if the shortest wavelength emitted by the loudspeaker elements is less than 68 cm, less than 17 cm.

16. Loudspeaker device according to claim 1, wherein said first signal is, or is equivalent to, the sum of a mid input signal (M) and a side input signal (S), and wherein said second signal is, or is equivalent to, the sum of a mid input signal (M) and a side signal (S) phase shifted 180°.

17. Loudspeaker device according to claim 16, wherein at least part of the side input signal (S) or the mid input signal (M) is phase shifted approximately 45°-135° prior to or at the production of the first and second signals.

18. Loudspeaker device according to claim 1, characterized in that said first and second loudspeaker elements are individually acoustically isolated by means of individual resonator volumes.

19. Apparatus, characterized in that it includes a loudspeaker device according to claim 1.

20. Apparatus according to claim 19, characterized in that said apparatus constitutes any from the group: Studio Monitor, HiFi system, Home Cinema system, Compact Hifi system, Personal Radio system, Car Stereo System, TV-Set, Laptop, PC Monitor, Personal Computer, Multimedia Speaker, Mobile Phone, PDA.

* * * * *

UNITED STATES PATENT AND TRADEMARK OFFICE

CERTIFICATE OF CORRECTION

PATENT NO. : 8,620,010 B2
APPLICATION NO. : 12/297225
DATED : December 31, 2013
INVENTOR(S) : Fredrik Gunnarsson It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1089 days.

Signed and Sealed this
Twenty-second Day of September, 2015

Michelle K. Lee

Michelle K. Lee
*Director of the United States Patent and Trademark Office*